US008632441B2

(12) United States Patent
Chen

(10) Patent No.: US 8,632,441 B2
(45) Date of Patent: Jan. 21, 2014

(54) MULTI-FUNCTION EXERCISER

(75) Inventor: Tsung-Jen Chen, Chiayi Hsien (TW)

(73) Assignee: Yu-Ting Chen, Taichung (TW)

( * ) Notice: Subject to any disclaimer, the term of this patent is extended or adjusted under 35 U.S.C. 154(b) by 192 days.

(21) Appl. No.: 13/229,690

(22) Filed: Sep. 10, 2011

(65) Prior Publication Data

US 2012/0231933 A1 Sep. 13, 2012

(30) Foreign Application Priority Data

Mar. 9, 2011 (TW) ..... 100204117 A

(51) Int. Cl.
*A63B 22/04* (2006.01)

(52) U.S. Cl.
USPC ..... 482/52; 482/51; 482/71; 482/907

(58) Field of Classification Search
USPC ..... 482/52, 51, 53, 57, 62, 70, 71
See application file for complete search history.

(56) References Cited

U.S. PATENT DOCUMENTS

| | | | | |
|---|---|---|---|---|
| 5,733,226 | A * | 3/1998 | Chen | 482/52 |
| 5,971,892 | A * | 10/1999 | Lee | 482/52 |
| 6,220,990 | B1 * | 4/2001 | Crivello | 482/51 |
| 2005/0014613 | A1 * | 1/2005 | Chu | 482/79 |
| 2008/0020902 | A1 * | 1/2008 | Arnold | 482/51 |
| 2008/0274860 | A1 * | 11/2008 | Lee | 482/52 |

FOREIGN PATENT DOCUMENTS

TW 375953 * 6/1999

* cited by examiner

*Primary Examiner* — Loan Thanh
*Assistant Examiner* — Nyca T Nguyen

(57) ABSTRACT

A multi-function exerciser includes a main frame. Two first universal joint units and two second universal joint units are respectively provided at two sides of the main frame. Two action units are pivotally connected to the first and second universal joint units. The two axes of the first and second universal joint units at the same side are at the same level and perpendicular to each other. Thus, the user can swing forward and rearward as well as left and right when standing on the footrests of the two action units for a forward split and a side split. Besides, because the two axes are at the same level and perpendicular to each other, the user can stand with one foot and lift another foot to do an oval turning for getting strong muscles in the legs.

2 Claims, 6 Drawing Sheets

MULTI-FUNCTION EXERCISER

BACKGROUND OF THE INVENTION

1. Field of the Invention

The present invention relates to an exerciser.

2. Description of the Prior Art

Taiwan Patent Publication Nos. 375953 and 492535 disclose a multi-function exerciser for leg split and glissade. The former exerciser is complicated in structure, which increases the manufacture cost. Therefore, another exerciser is developed, Taiwan Patent Publication No. M 383425, which has a simple structure. However, it only provides walk and leg split functions.

SUMMARY OF THE INVENTION

The primary object of the present invention is to provide a multi-function exerciser which is simple in configuration and provides multiple functions for the user to swing forward and rearward as well as left and right and to lift his/her leg for a turning.

In order to achieve the object, the present invention comprises a main frame. Two first universal joint units and two second universal joint units are respectively provided at two sides of the main frame. Two action units are respectively and pivotally connected the first and second universal joint units at the same side for the user to stand. Thus, the user can stand on footrests of the action units to swing forward and rearward with his/her both, so that the action units at the two sides can swing forward and rearward relative to the first and second universal joint units. In addition, the user also can extend the legs to the left and right by means of the two action units to swing left and right relative to the first and second universal joint units.

Besides, because the two axes of the first and second universal joint units are at the same level and perpendicular to each other, the footrests of the action units can have an oval motion relative to the first and second universal joint units. The user can stand with one foot and lift another foot for an oval turning. The present invention provides varied choices for exercises.

DETAILED DESCRIPTION OF THE PREFERRED EMBODIMENTS

Embodiments of the present invention will now be described, by way of example only, with reference to the accompanying drawings.

Figure 1:
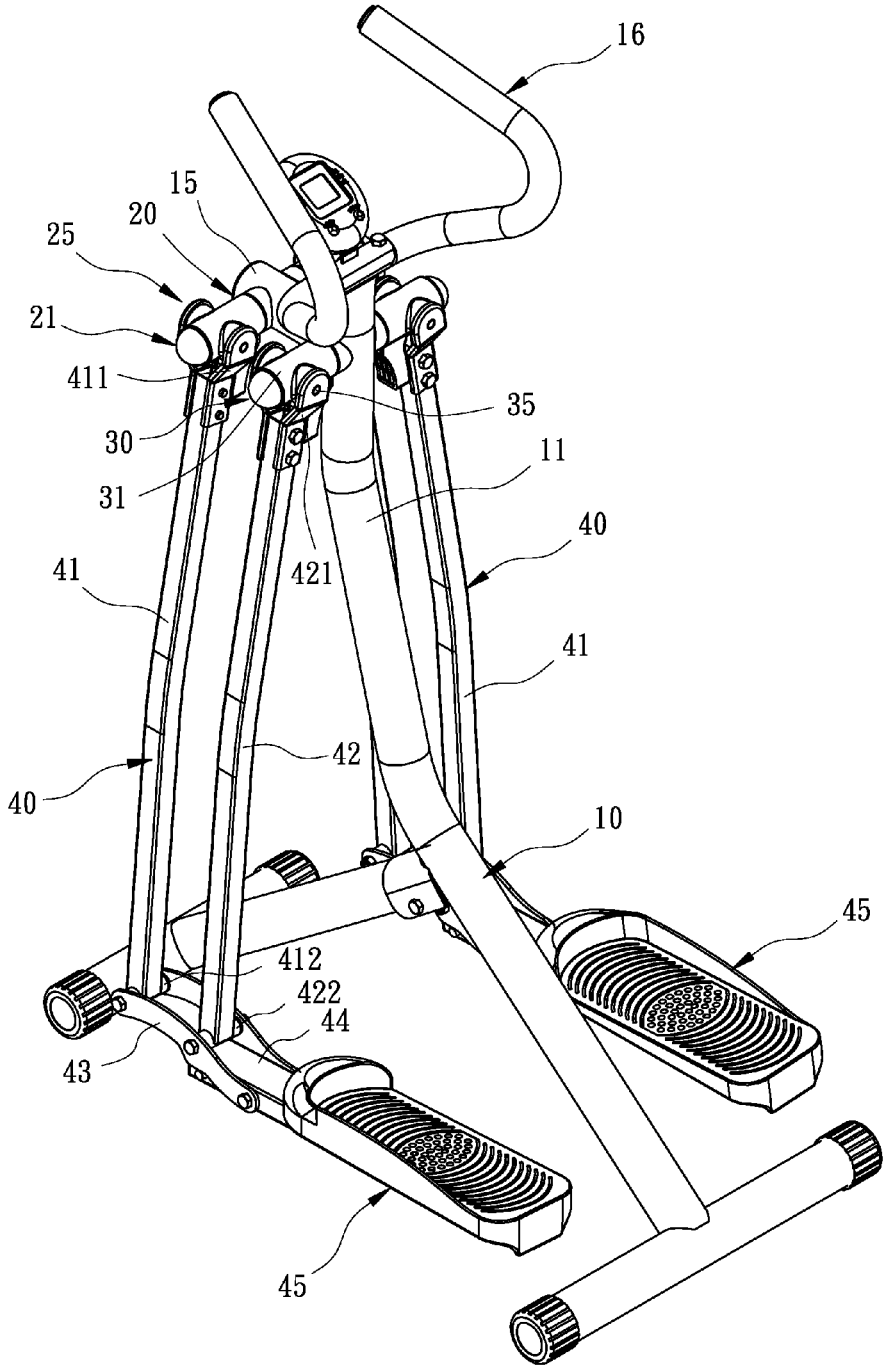
FIG. 1 is a perspective view according to a preferred embodiment of the present invention.
Figure 2:
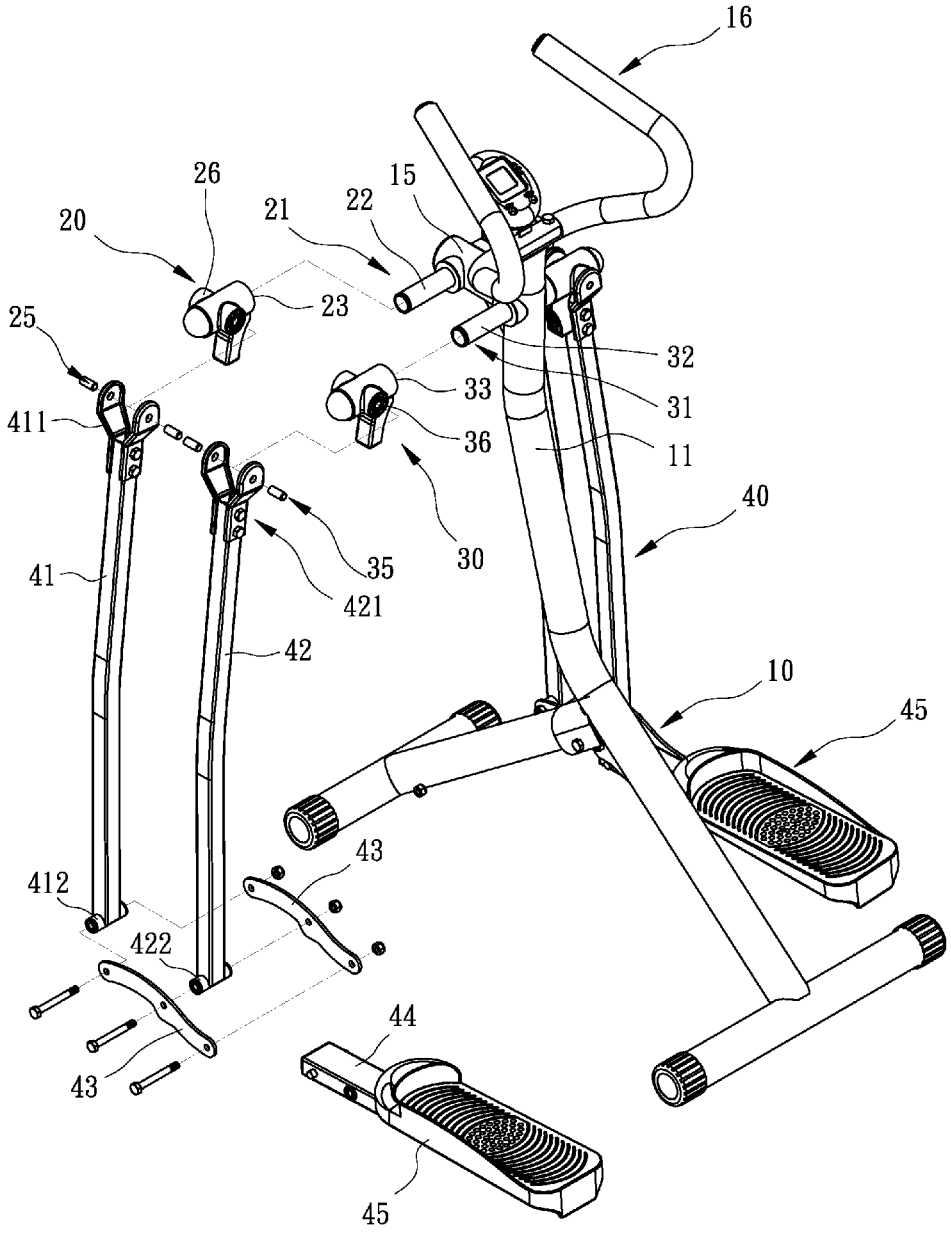
FIG. 2 is an exploded view according to the preferred embodiment of the present invention.
Figure 3:
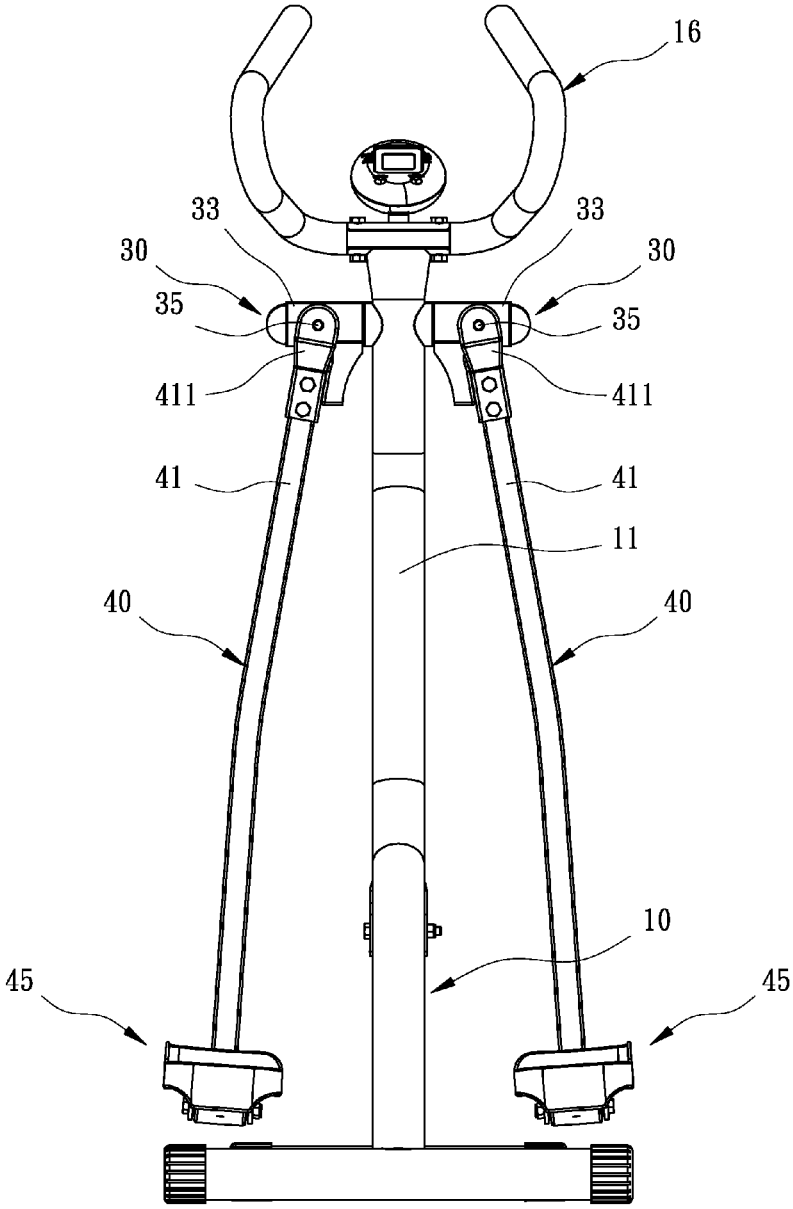
FIG. 3 is a front view according to the preferred embodiment of the present invention.

As shown in FIG. 1, FIG. 2 and FIG. 3, a multi-function exerciser according to a preferred embodiment of the present invention comprises a main frame 10, two first universal joint units 20, two second universal joint units 30, and two action units 40.

The main frame 10 is for the whole exerciser to stand on the ground stably. The main frame 10 has a post 11 protruding upward from a central portion thereof. The post 11 has a support member 15 at an upper end thereof. The support member 15 is adapted for mounting a handle 16 or a control board.

The two first universal joint units 20 are respectively connected to two front sides of the support member 15 of the main frame 10. Each first universal joint unit 20 has a first swing axle portion 21 for the relative action unit 40 to swing forward and rearward and a second swing axle portion 25 for the relative action unit 40 to swing left and right. The first swing axle portion 21 and the second swing axle portion 25 are at the same level and perpendicular to each other. The first swing portion 21 of each first universal joint unit 20 of the present invention further comprises a shaft 22 which is located at a front section of the support member 15 and a shaft sleeve 23 fitted on the shaft 22. The shaft sleeve 23 can turn forward and rearward relative to the shaft 22. The second swing axle portion 25 has a protruding shaft 26 extending from two opposing sides of the shaft sleeve 23. The relative action unit 40 is pivotally connected to the protruding shaft 26, so that the relative action unit 40 can swing left and right relative to the protruding shaft 26.

The two second universal joint units 30 are respectively connected to two rear sides of the support member 15 of the main frame 10 and correspond to the first universal joint units 20. Each second universal joint unit 30 has a first swing axle portion 31 for the relative action unit 40 to swing forward and rearward and a second swing axle portion 35 for the relative action unit 40 to swing left and right. The first swing axle portion 31 and the second swing axle portion 35 are at the same level and perpendicular to each other. The first swing axle portion 31 of the second universal joint unit 30 is parallel to the first swing axle portion 21 of the first universal joint unit 20. The first swing portion 31 of each second universal joint unit 30 of the present invention further comprises a shaft 32 which is located at a rear section of the support member 15 and a shaft sleeve 33 fitted on the shaft 32. The shaft sleeve 33 can turn forward and rearward relative to the shaft 32. The second swing axle portion 35 has a protruding shaft 36 extending from two opposing sides of the shaft sleeve 33. The relative action unit 40 is pivotally connected to the protruding shaft 36, so that the relative action unit 40 can swing left and right relative to the protruding shaft 36.

The two action units 40 are located at two sides of the main frame 10 and connected to the respective first and second universal joint units 20, 30 at the same side. Each action unit 40 has a first lever 41 and a second lever 42 which are pivotally connected to the first universal joint unit 20 and the second universal joint unit 30, respectively. The first lever 41 has a pivot seat 411 at an upper end thereof for connecting the protruding shaft 26 and a connecting pivot portion 412 at a lower end thereof. The second lever 42 has a pivot seat 421 at an upper end thereof for connecting the protruding shaft 36 and a connecting pivot portion 422 at a lower end thereof. At least one side of each action unit 40 is provided with a connecting plate 43 which is connected to the connecting pivot portions 412, 422 of the first and second levers 41, 42. In this embodiment, there are two parallel connecting plates 43 connected to the connecting pivot portions 412, 422 of the first and second levers 41, 42. A distal end of the connecting plate 43 is pivotally connected to a middle section of a base rod 44. A front end of the base rod 44 is flush with a bottom edge of the connecting pivot portion 422 of the second lever 42. The base rod 44 can bring a footrest 45 to be folded upward. The footrest 45 is disposed on the base rod 44, and selectively connected to the base rod 44 in a fixed way or in a pivot way. Thus, the present invention provides multiple functions for exercises, with a simple configuration.

Figure 4:
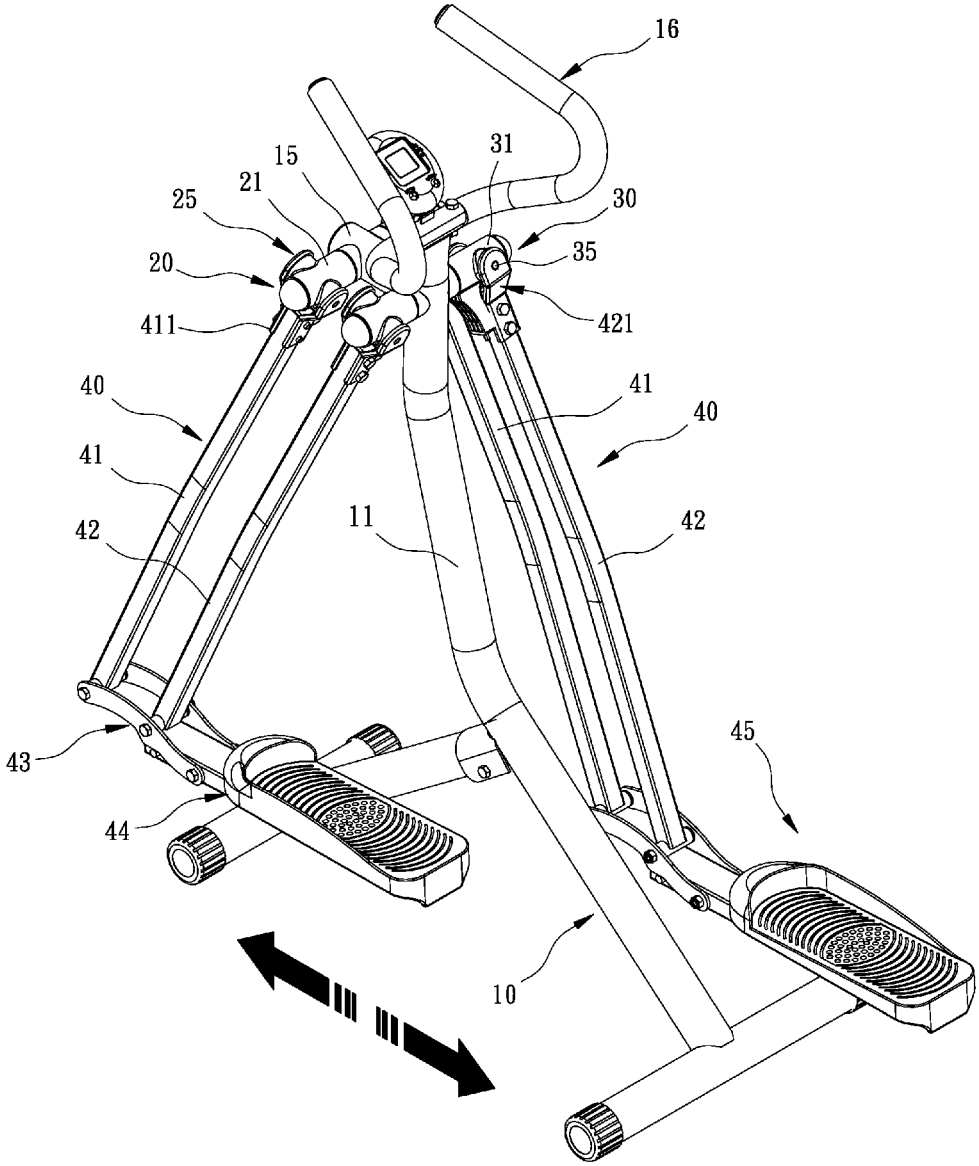
FIG. 4 is a schematic view showing a forward/rearward swing according to the preferred embodiment of the present invention.

In use, referring to FIG. 1 and FIG. 4, the user can stand on the footrests 45 of the two action units 40 to do forward/rearward swing with his/her both feet, such that the first and second levers 41, 42 of the two action units 40 are brought to swing forward and rearward. The pivot seats 411, 421 of the first and second levers 41, 42 are pivotally connected to the protruding shafts 26, 36 of the second swing portions 25, 35 of the first and second universal joint units 20, 30, so that the shaft sleeves 23, 33 are driven to swing forward and rearward relative to the shafts 22, 32 of the first swing axle portions 21, 31. This brings the footrests 45 of the two action units 40 to swing forward and rearward, so the user can stretch his/her legs forward and rearward.

Figure 5:
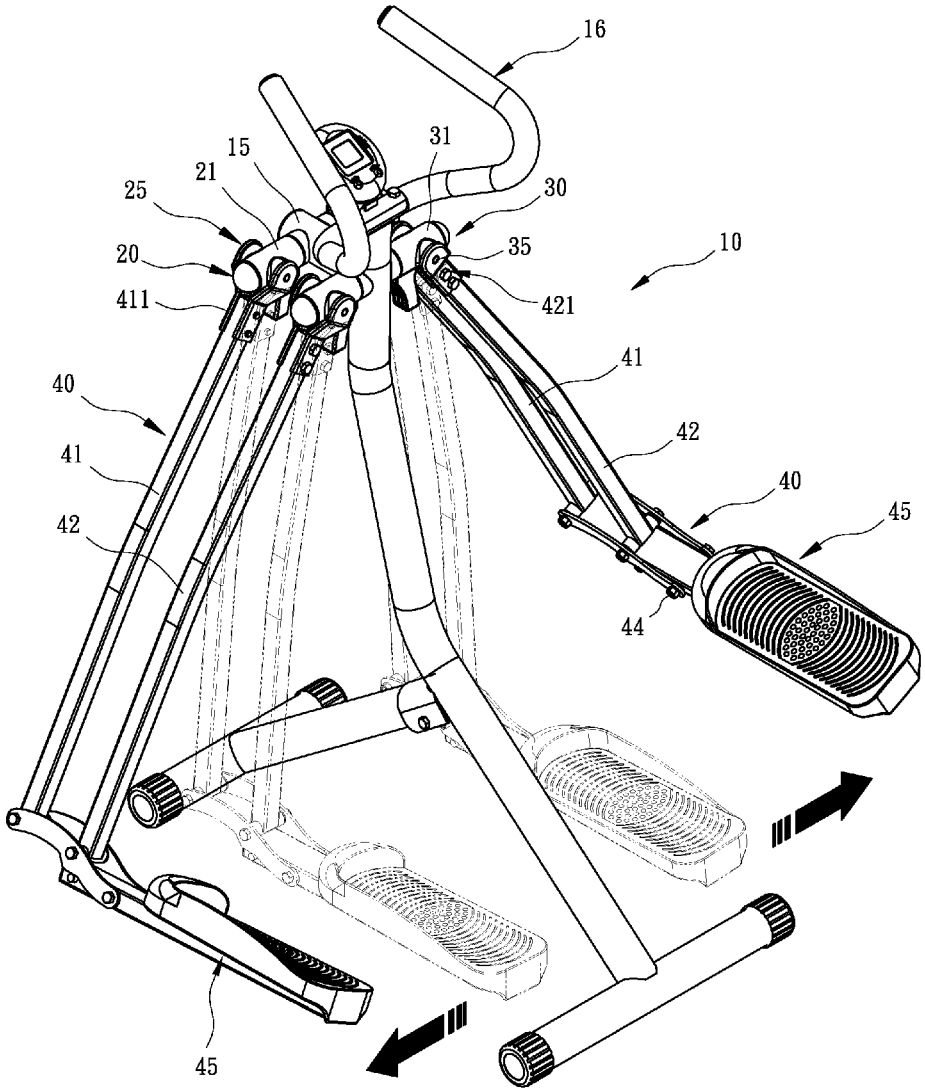
FIG. 5 is a schematic view showing a left/right swing according to the preferred embodiment of the present invention.

Referring to FIG. 3 and FIG. 5, the user can stand on the footrests 45 of the two action units 40 to extend the legs to the left and right by means of the first and second levers 41, 42 of the two action units 40. The pivot seats 411, 421 of the first and second levers 41, 42 are pivotally connected to the protruding shafts 26, 36 of the second swing portions 25, 35 of the first and second universal joint units 20, 30, such that the action units 40 can swing left and right relative to the second swing portions 25, 35. This brings the footrests 45 of the two action units 40 to swing left and right, so the user can do a side split.

Figure 6:
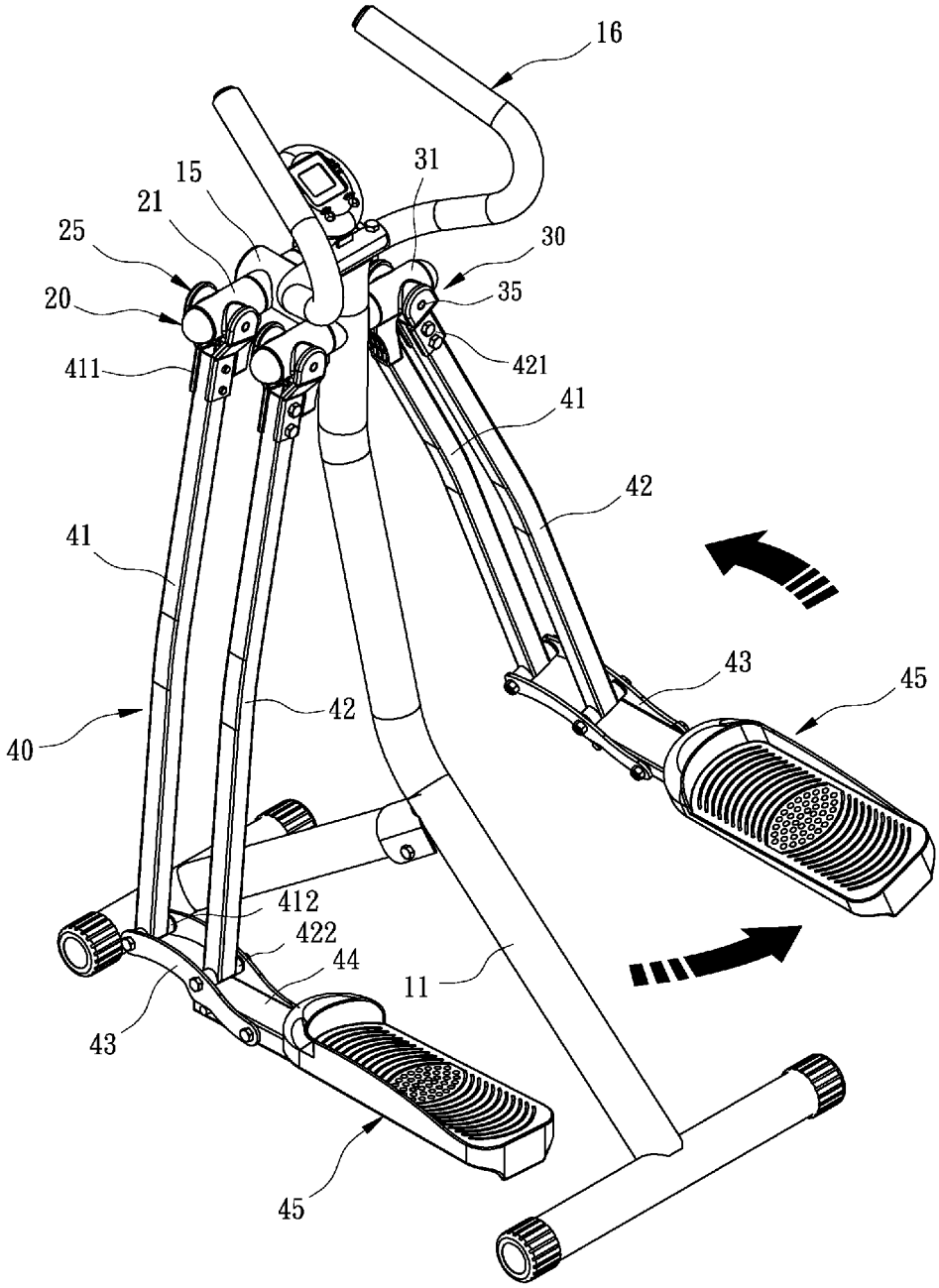
FIG. 6 is a schematic view showing an oval turning according to the preferred embodiment of the present invention.

Furthermore, referring to FIG. 1 and FIG. 6, the user can stand on the footrests 45 of the two action units 40 to lift his/her leg. One foot is stationary and the other foot is lifted outward for an oval turning. The first swing axle portions 21, 31 and the second swing axle portions 25, 35 of the first and second universal joint units 20, 30 are at the same level and perpendicular to each other, providing a universal joint effect, such that the footrest 45 of the action unit 40 can have an oval motion relative to the first and second universal joint units 20, 30 at the same side.

By the aforesaid design, the exerciser of the present invention can provide different choices for exercises. With the two action units 40 relative the first swing axle portions 21, 31 and the second swing axle portions 25, 35 of the first and second universal joint units 20, 30, the present invention provides a frontward/rearward swing as well as a left/right swing. Besides, because the first swing axle portions 21, 31 and the second swing axle portions 25, 35 of the first and second universal joint units 20, 30 are at the same level and perpendicular to each other, the present invention can provide an oval motion turning by lifting one foot.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-function exerciser comprising a main frame, two first universal joint units, two second universal joint units and two action units;

the main frame having a support member at an upper end thereof;

the two first universal joint units being respectively connected to two front sides of the support member of the main frame, each first universal joint unit having a first swing axle portion for the relative action unit to swing forward and rearward and a second swing axle portion for the relative action unit to swing left and right, the first swing axle portion and the second swing axle portion being at a common height and perpendicular to each other;

the two second universal joint units being respectively connected to two rear sides of the support member of the main frame, each second universal joint unit having a first swing axle portion for the relative action unit to swing forward and rearward and a second swing axle portion for the relative action unit to swing left and right, the first swing axle portion and the second swing axle portion being at a common height and perpendicular to each other;

the two action units being located at two sides of the main frame and connected to the respective first and second universal joint units, each action unit having a first lever and a second lever which are respectively and pivotally connected to the first universal joint unit and the second universal joint unit, the first lever and the second lever having pivot seats at upper ends thereof for connecting the second swing axle portions of the first and second universal joint units, the first lever and the second lever having connecting pivot portions at lower ends thereof, a base rod connected to the connecting pivot portions of the first and second levers, a footrest provided on the base rod;

wherein the first swing axle portions of the first and second universal joint units each include a shaft disposed on the support member and a shaft sleeve fitted on the shaft, wherein the second swing axle portions of the first and second universal joint units each include a protruding shaft extending from two opposing sides of the shaft sleeve for connecting the pivot seats of the first and second levers of the relative action units.

2. The multi-function exerciser as claimed in claim 1, wherein at least one side of each action unit is provided with a connecting plate which is connected to the connecting pivot portions of the first and second levers, a distal end of the connecting plate being pivotally connected to a middle section of the base rod, a front end of the base rod being flush with a bottom edge of the connecting pivot portion of the second lever for the footrest to be folded upward.

* * * * *